US006559401B2

(12) United States Patent
Minami et al.

(10) Patent No.: US 6,559,401 B2
(45) Date of Patent: May 6, 2003

(54) LEVER SWITCH

(75) Inventors: Katsuichi Minami, Fukui (JP); Masaki Nakase, Fukui (JP); Yasuchika Kudo, Fukui (JP); Yusho Nakase, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/018,403

(22) PCT Filed: Apr. 13, 2001

(86) PCT No.: PCT/JP01/03190

§ 371 (c)(1),
(2), (4) Date: May 6, 2002

(87) PCT Pub. No.: WO01/80264

PCT Pub. Date: Oct. 25, 2001

(65) Prior Publication Data

US 2002/0148714 A1 Oct. 17, 2002

(30) Foreign Application Priority Data

Apr. 14, 2000 (JP) ..... 2000-113741

(51) Int. Cl.[7] ..... H01H 21/24
(52) U.S. Cl. ..... 200/559; 200/339; 200/553
(58) Field of Search ..... 200/1 A, 1 TK, 200/6 R, 6 B, 6 BB, 6 C, 16 C, 16 D, 283, 284, 303, 339, 440, 441, 553, 557, 558, 559

(56) References Cited

U.S. PATENT DOCUMENTS 4,319,107 A * 3/1982 Haskins ..... 200/339 X
4,359,611 A * 11/1982 Haskins ..... 200/1 TK
4,389,549 A * 6/1983 Brown ..... 200/6 B X
4,767,900 A * 8/1988 Beurdeley et al. ..... 200/339 X
5,796,058 A * 8/1998 Aimi et al. ..... 200/553 X
6,242,706 B1 * 6/2001 Miyata ..... 200/558 X

FOREIGN PATENT DOCUMENTS

| | | |
|---|---|---|
| EP | 1195787 A1 * | 4/2002 |
| JP | 8-55538 | 2/1996 |
| JP | 9-282977 | 10/1997 |
| JP | 10-21788 | 1/1998 |
| JP | 11-260201 | 3/1999 |

OTHER PUBLICATIONS

Japanese search report for PCT/JP01/03190 dated May 22, 2001.

* cited by examiner

*Primary Examiner*—J. R. Scott
(74) *Attorney, Agent, or Firm*—RatnerPrestia

(57) ABSTRACT

A lever switch assures stable contact just after having its contact points contacted with each other when a lever is rotated. The lever switch includes a case, a common contact and a fixed contact both provided to case's side walls adjacent to each other, a lever rotatably held by at an opening provided in a side wall facing the common contact, a movable contact which electrically contacts and removes between the common contact and the fixed contact through being bent with the lever being rotated. A fixed section disposed at a tip of a first arm of the fixed contact is press-fitted between the common contact and a supporting protrusion. A contact section disposed at a tip of a second arm of the fixed contact elastically contacts with the left-side wall of the case. A driving section of the lever comes into contact with a bent section of the first arm of the movable contact.

10 Claims, 9 Drawing Sheets

LEVER SWITCH

This application is a U.S. national phase application of PCT international application pct/JP01/03190, filed Apr. 13, 2001.

TECHNICAL FIELD

The present invention relates to lever switch for detecting a recording medium or a movement of a mechanism in various electronic apparatuses.

BACKGROUND ART

A lever switch is used for detecting a recording medium or a movement of a mechanism in various electronic apparatus. Among various types of lever switches, a leaf-switch is well-known in the market. The leaf switch includes a movable contact and a fixed contact, and both of the contacts are made of elastic and thin metal plates facing each other via a given space. The contacts contact with each other by rotating a lever.

A conventional lever switch as discussed above is described with reference to FIG. 10 and FIG. 11. FIG. 10 is a sectional view of the conventional lever switch. Box-shaped case 1 made of insulating resin opens frontward and has opening 1A on the left side. Lever 2 is rotatably held by case 1 at shaft section 2A. A first end of lever 2, i.e., driving section 2A, is housed in case 1, and a second end, i.e., handle section 2C, protrudes out of opening 1A upward slantingly. Movable contact 3 and fixed contact 4, both being made of elastic and thin metal plate, are rigidly mounted to side-wall 1B opposite to opening 1A. An end of movable contact 3 elastically contacts with an upper face of driving section 2B, and moves handle section 2C upward slantingly. Contact section 4A slightly bowed downward is provided to an end of fixed contact 4 opposite to an intermediate portion of movable section 3. A front face of case 1, which accommodates movable contact 3 and fixed contact 4, is covered with a cover (not shown). Lever 2 is rotatably held at shaft section 2A.

As shown in FIG. 11, when handle section 2C of lever 2 is rotated downward, driving section 2B rotates and moves upward on shaft section 2A as a fulcrum and pushes up the left end of movable contact 3. This action bends movable contact 3, and brings the intermediate portion into contact with contact section 4A of fixed contact 4.

When handle section 2C rotates by a given stroke, the end of movable contact 3 further moves upward, which bends fixed contact 4 upward, so that movable contact 3 may contact with fixed contact 4 by a stable contact pressure.

When operating-force applied to handle section 2C is released, driving section 2B is depressed downward by elastic restoring force of movable contact 3 and fixed contact 4, and lever 2 rotates and handle section 2C returns to the status shown in FIG. 10.

In the conventional lever switch discussed above, movable contact 3 contacts with contact section 4A of fixed contact 4 by rotating handle section 2C of lever 2. Then, lever 2 is further rotated to bend fixed contact 4, thereby obtaining a stable contact pressure between movable contact 3 and fixed contact 4. However, the contact remains unstable before lever 2 completes its rotation.

DISCLOSURE OF THE INVENTION

The present invention aims to provide a lever switch which assures stable contact just after both contacts touch with each other. The lever switch includes the following elements:

(a) a case including a first side-wall, a second side-wall adjacent to the first side-wall, and a third side-wall having an opening;

(b) a common contact provided to the first side-wall;

(c) a first fixed contact provided to the second side-wall;

(d) a supporting protrusion disposed around the common contact in the case;

(e) a lever including:

a shaft section rotatably held at the opening and being disposed at an intermediate portion of the lever;

a driving section housed in the case and disposed at a first end of the lever; and a handle section protruded from the opening outside the case and disposed at a second end of the lever, (f) an elastic movable contact, being formed in an approximate V-shape, including:

a bent section housed in the case with the driving section touched around the bent section, and the bent section being disposed at an intermediate portion of the movable contact;

a first arm extending from a first side of the bent section;

a fixed section, being formed in an approximate square U-shape, provided to a tip of the first arm and fixed between the common contact and the supporting protrusion;

a second arm extending from a second side of the bent section; and a contact section being provided at a tip of the second arm and elastically contacting with both the first fixed contact and the second side-wall.

The contact section of the movable contact, which is slightly bent, elastically slides on the side-wall of the case or on the fixed contact, thereby touching or leaving the fixed contact. Therefore, even while the lever is rotating, the movable contact is kept in contact with the fixed contact by a constant pressure.

DESCRIPTION OF THE PREFERRED EMBODIMENTS

Exemplary embodiments of the present invention are demonstrated hereinafter with reference to the accompanying drawings.

Exemplary Embodiment 1

Figure 1:
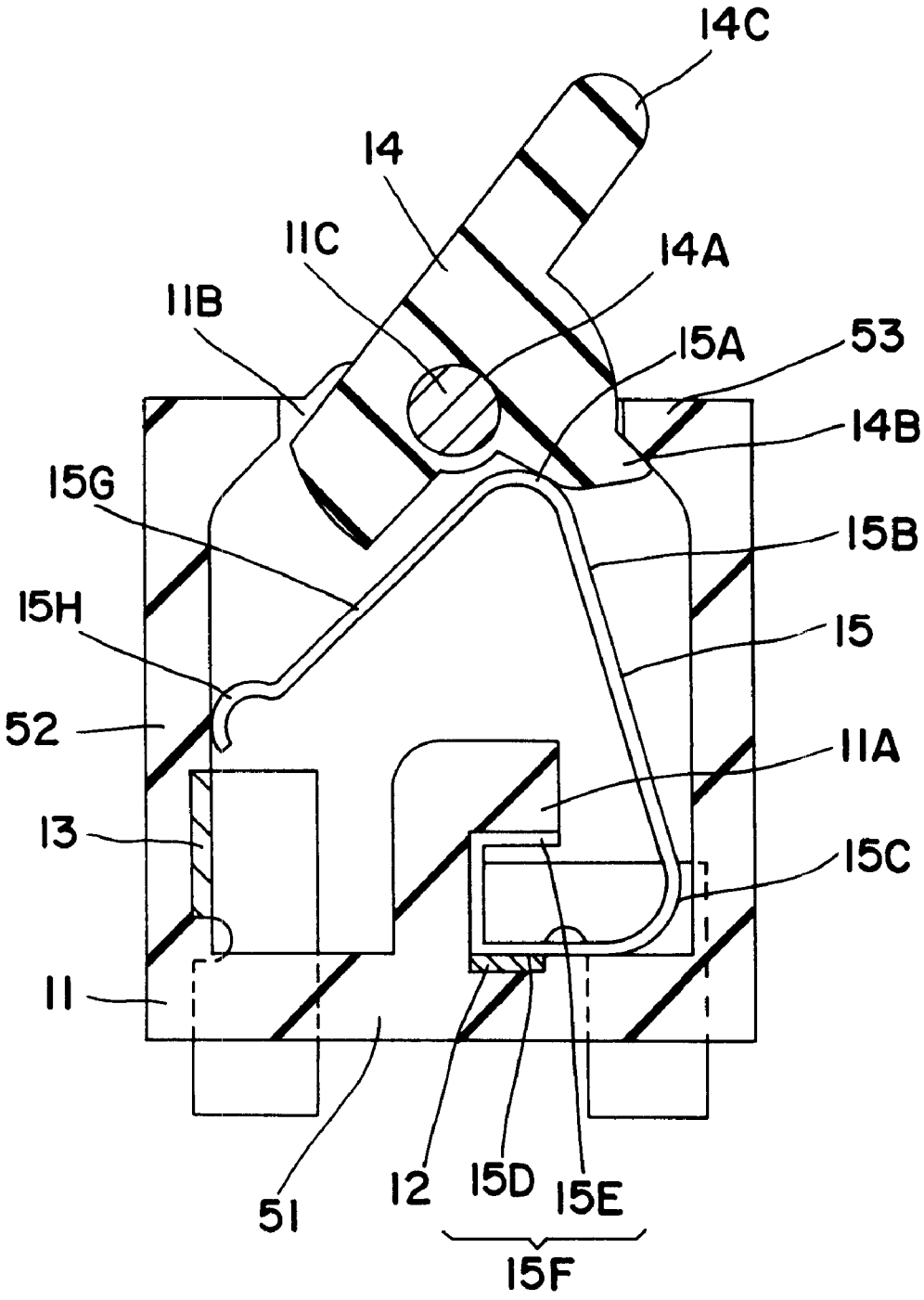
FIG. 1 is a sectional view of a lever switch in accordance with a first exemplary embodiment of the present invention.
Figure 2:
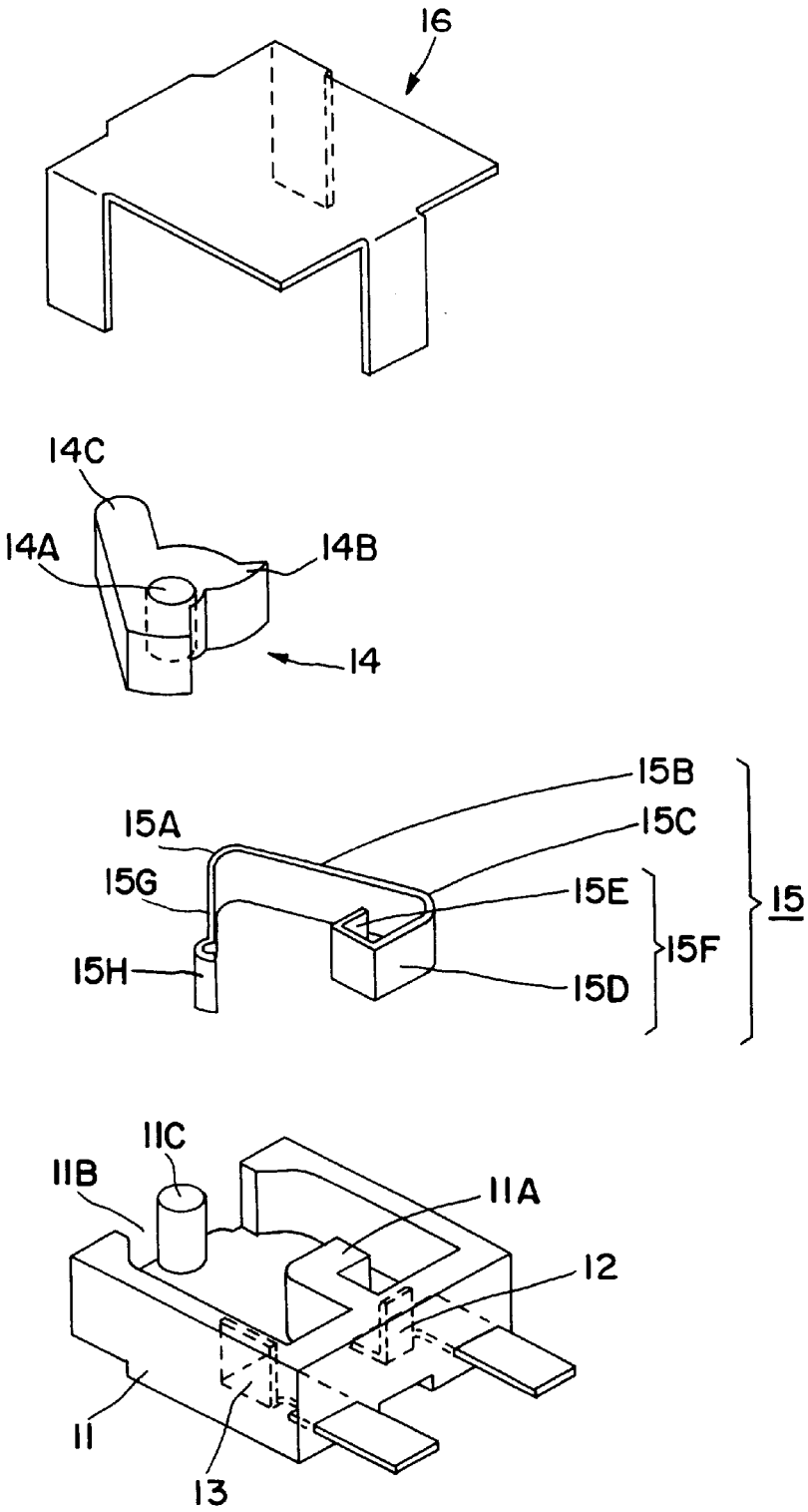
FIG. 2 is a perspective exploded view of the lever switch in accordance with the first embodiment.

FIG. 1 is a sectional view of a lever switch in accordance with a first exemplary embodiment of the present invention. FIG. 2 is a perspective exploded view of the lever switch. Common contact 12 made of conductive metal is rigidly mounted to a lower-side wall 51 of box-shaped case 11 made of insulating resin. Case 11 opens forward. Fixed contact 13 made of conductive metal is rigidly mounted to a left-side wall 52 adjacent to the lower-side wall 51. Both the contacts are rigidly mounted by, e.g., insert molding. Supporting protrusion 11A facing contact 12 is formed on case 11 around contact 12 via a given space. Cylindrical supporting shaft 11C is formed at opening 11B of an upper-side wall 53 opposite to contact 12. Lever 14 made of insulating resin is held rotatably by supporting shaft 11C at shaft hole 14A disposed at a shaft section located at an intermediate portion of the lever. Driving section 14B at a first end of lever 14 is housed in case 11, and handle section 14C at a second end of lever 14 protrudes out of opening 11B upward slantingly. Movable contact 15, made of thin and elastic metal plate and shaped in an approx. V-letter narrower than the depth of case 11, is housed in case 11 with bent section 15A slightly bent. Bent section 15A is disposed at intermediate portion of movable contact 15. At the tip of first arm 15B extending from a first end of bent section 15A, fixed section 15F is disposed. Fixed section 15F is shaped in an approx. E-letter without the middle bar, and includes connecting section 15D and fitting section 15E via curve section 15C. Connecting section 15D elastically contacts with common contact 12, and fitting section 15E elastically contacts with supporting protrusion 11A with fixed section 15F slightly bent. Fixed section 15F is press-fitted between common contact 12 and supporting protrusion 1. A side face of driving section 14B of lever 14 elastically contacts with around bent section 15A. Another side face of driving section 14B elastically contacts with a lower face of opening 11B, thereby positioning driving section 14B. Contact section 15H-disposed at the tip of second arm 15G extending from a second end of bent section 15A-elastically contacts with the left-side wall 52 of case 11. These elements are housed in case 11, and the front face of case 11 is covered by cover 16 shown in FIG. 2. Lever 14 is rotatably held at shaft hole 14A.

Figure 3:
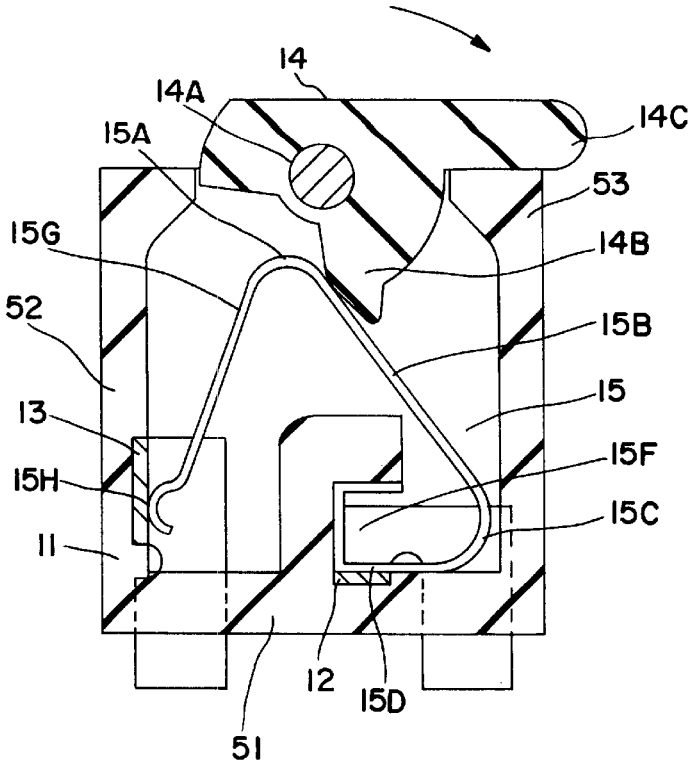
FIG. 3 is a sectional view of the lever switch in operation in accordance with the first embodiment.

When handle section 14C of lever 14 is rotated downward, driving section 14B rotates clockwise on shaft hole 14A as a fulcrum as shown in the sectional view of FIG. 3. Driving section 14B pushes bent section 15A of first arm 15B against the left-side wall 52 of driving section 14B, so that movable contact 15 rotates counterclockwise on curve section 15C as a fulcrum. Contact section 15H disposed at the tip of second arm 15G slides on the left-side wall 52 of case 11 downward and elastically contacts with fixed contact 13. Common contact 12 thus electrically contacts with fixed contact 13 via movable contact 15.

When operating-force applied to handle section 14C is released, contact section 15H leaves fixed contact 13 and slides elastically on the left-side wall 52 of case 11 upward due to elastic restoring force of movable contact 15. Further, the left side of driving section 14B is urged to bent section 15A of first arm 15B, thereby rotating lever 14. Then, handle section 14C returns to the status shown in FIG. 1.

According to this first embodiment, fixed section 15F of movable contact 15 Is press-fitted between common contact 12 and supporting protrusion 11A, and contact section 15H at the tip of second arm 15G slides elastically on the left-side wall 52 of case 11 and fixed contact 13 with a given pressure. Contact section 15H accordingly contacts with and leaves fixed contact 13. Therefore, even while lever 14 is rotating, a constant pressure is applied to the contacts just after movable contact 15 contacts with fixed contact 13. As a result, stable contact can be expected.

Figure 4:
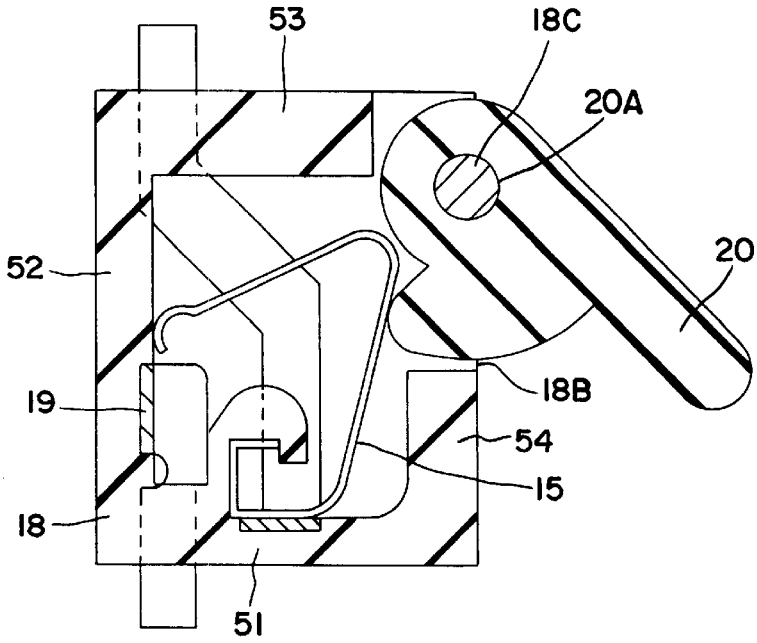
FIG. 4 is a cross section of another lever switch in accordance with the first embodiment.

In the description above, opening 11B is provided on the upper-side wall 53 opposite to common contact 12, and lever 14 is held rotatably by supporting shaft 11C at shaft hole 14A. However, as shown in the sectional view of FIG. 4, opening 18B can be provided to the right-side wall 54 opposite to fixed contact 19 of case 18, and lever 20 can be rotatably held by supporting shaft 18C at shaft hole 20A.

In this embodiment, a push-on switch is demonstrated. In other words, contact section 15H elastically contacting with the left-side wall 52 of case 11 contacts with fixed contact 13 by rotating handle section 14C of lever 14. Contrary to this type of switch, if fixed contact 13 is disposed at upper section of the left-side wall 52 of case 11, contact section 15H previously contacts electrically with fixed contact 13. Then, movable contact 15 leaves fixed contact 13 by rotating of lever 14 for turn-off. As a result, a push-off switch can be provided.

Figure 5:
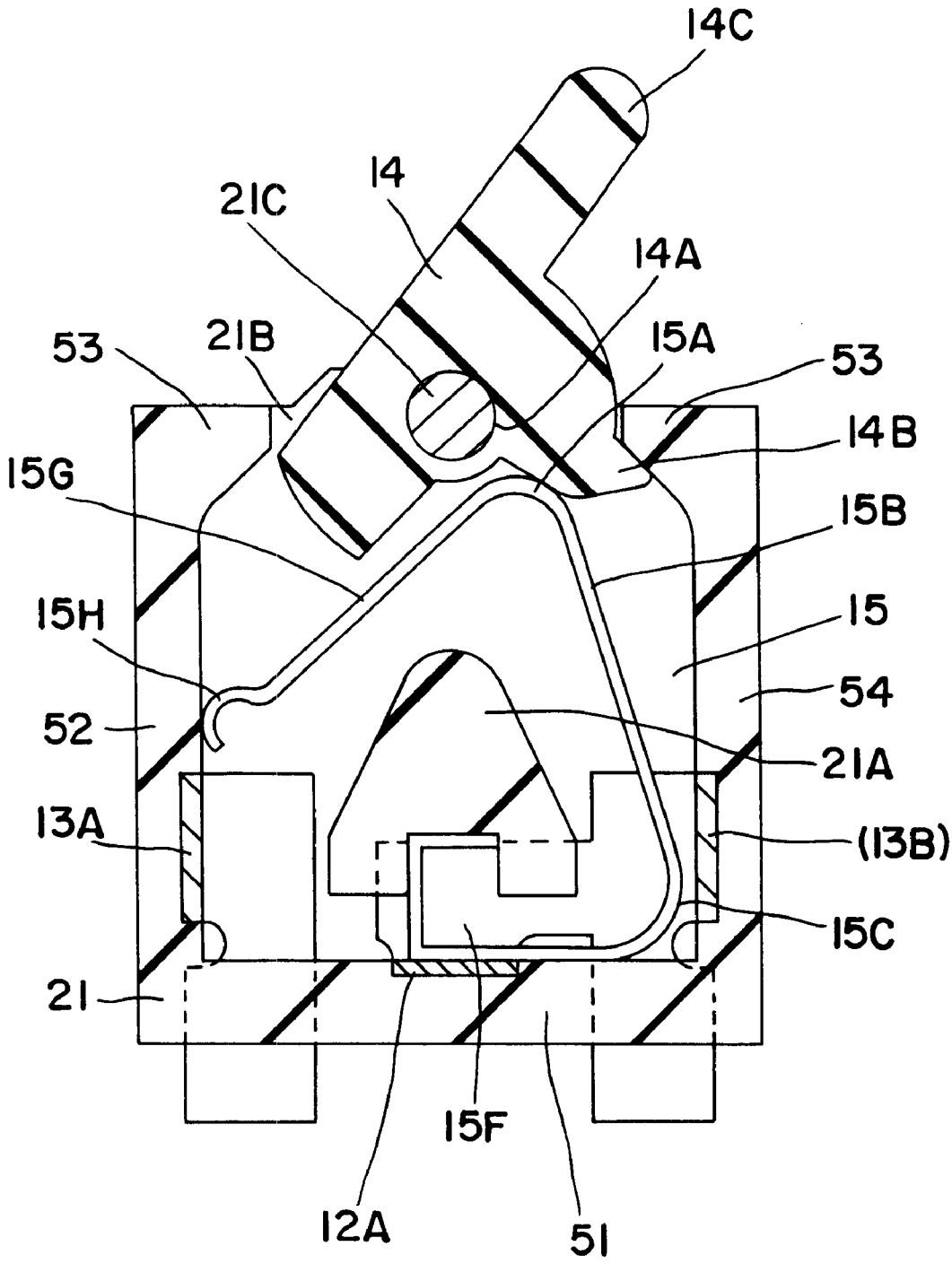
FIG. 5 is a sectional view of a lever switch in accordance with a second exemplary embodiment of the present invention.

The similar elements to those used in the first embodiment have the same reference marks, and the detailed descriptions thereof are omitted here. FIG. 5 is a sectional view of a lever switch in accordance with the second exemplary embodiment of the present invention. Common contact 12A is rigidly mounted to the lower-side wall 51 of case 21, and fixed contact 13A is rigidly mounted to the left-side wall 52 adjacent to the lower-side wall 51 in the same manner as the first embodiment. Both the contacts are mounted by, e.g., insert-molding. Common contact 12A is disposed at the center of the lower-side wall 51. Supporting protrusion 21A is faced to and formed around common contact 12A. Opening 21B is provided to the center of the upper-side wall 53 opposite to common contact 12A. Lever 14 is rotatably held by supporting shaft 21C at shaft hole 14A formed at an intermediate portion of lever 14. Shaft 21C is disposed at the center of opening 21B. Movable contact 15 is housed in case 21 with bent section 15A slightly bent. Fixed section 15F is press-fitted between common contact 12A and supporting protrusion 21A. Contact section 15H at the tip of second arm 15G elastically contacts with the left-side wall 52 of case 21.

Figure 6A:
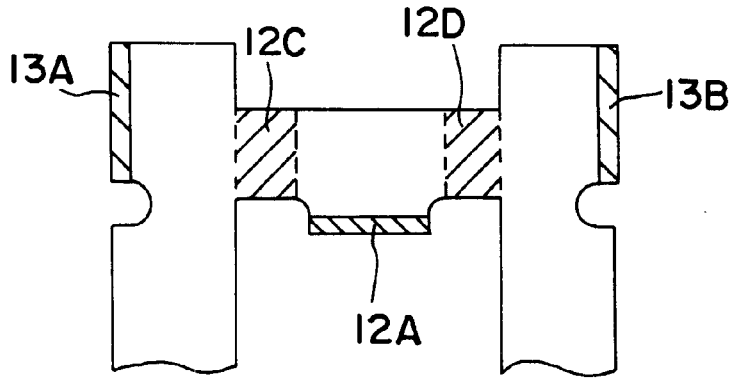
FIG. 6A and FIG. 6B are partial sectional views of the lever switch in accordance with the second embodiment.

Common contact 12A is coupled to fixed contact 13A at lower ends of the contacts with a link section (not shown) as shown in the partial sectional view of FIG. 6A. Common contact 12A, fixed contacts 13A and 13B are linked with cut-sections 12C and 12D, thereby forming a belt-like hoop. In the switch shown in FIG. 5, cut section 12C is cut off, and contacts 12A, 13A and 13B are insert-molded and rigidly mounted to case 21 made of insulating resin. In this case, since fixed contact 13B is linked to common contact 12A, fixed contact 13B is not used as a fixed contact, which contact section 15H of movable contact 15 is supposed to contact with and leaves, but used as common contact 12A.

Figure 6B:
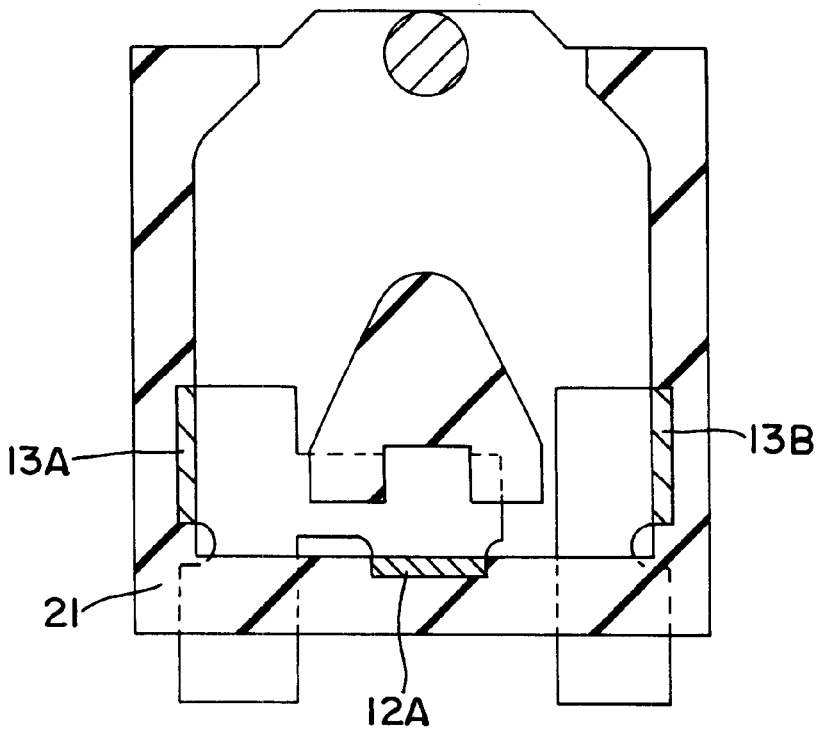

When cut section 12D is cut off in the status shown in FIG. 6A, fixed contact 13A is linked to common contact 12A with cut section 12C as shown in FIG. 6B. Fixed contact 13A and common contact 12A are thus rigidly mounted to case 21.

Figure 7:
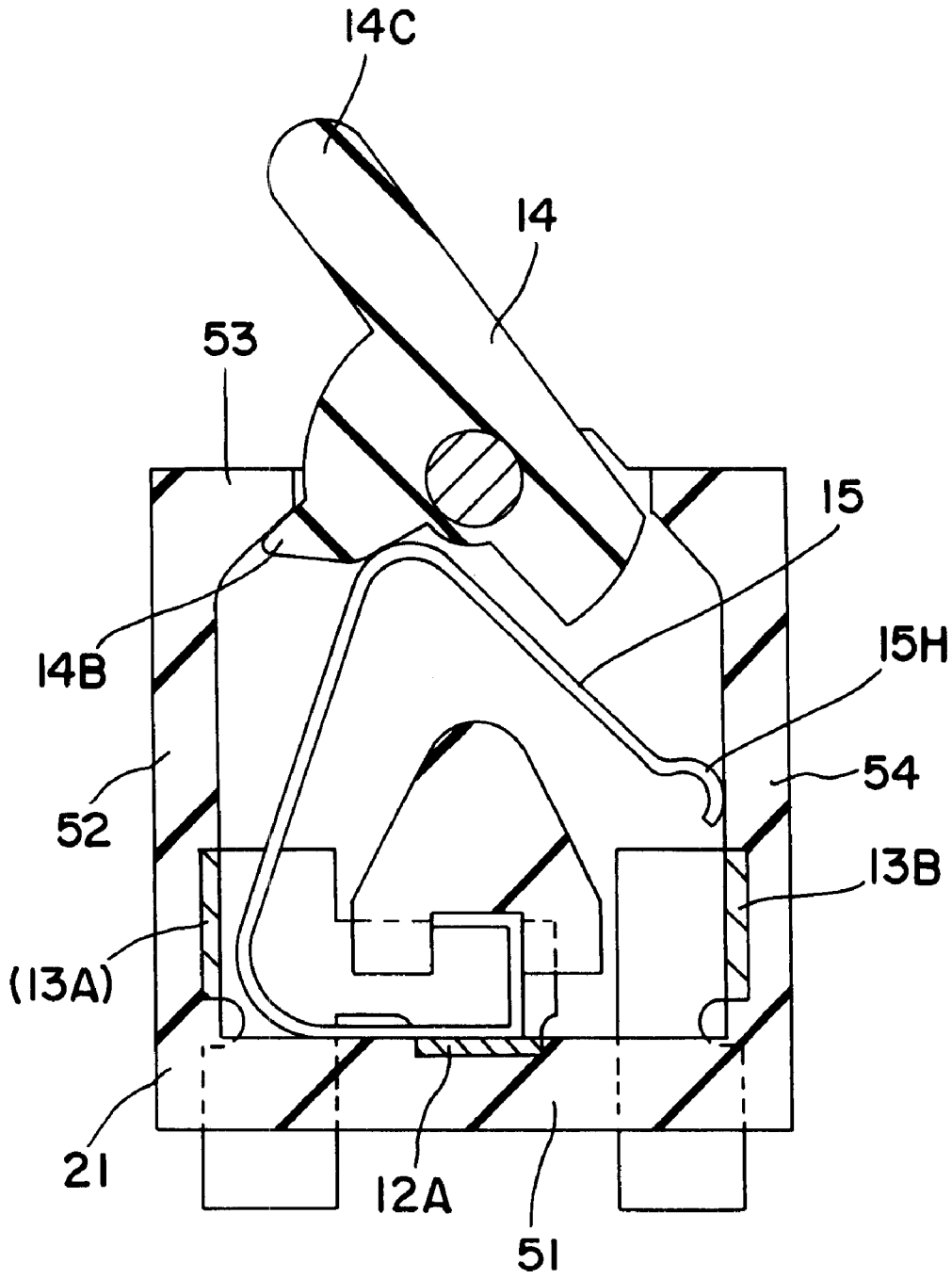
FIG. 7 is a cross section of another lever switch in accordance with the second embodiment.

As shown in the sectional view of FIG. 7, case 21 in this status discussed above can be utilized with lever 14 and movable contact 15 combined opposite in right and left to the lever switch shown in FIG. 5. In this case, contact section 15H elastically contacts with the right-side wall 54 of case 21, 50 that a lever switch—made from the same elements and yet having a different rotating direction of lever 14—is provided.

When handle section 14C is rotated downward by given force, driving section 14B pushes bent section 15A of first arm 15B, and movable contact 15 rotates on curve section 15C as a fulcrum. Then, contact section 15H elastically slides on the left-side wall 52 or right-side wall S4, so that common contact 12A may electrically contact with fixed contacts 13A, 13B via movable contact 15.

As discussed above, the lever switch in accordance with the second embodiment has a symmetrical structure. Therefore, locations of fixed contacts 13A, 13B can be changed, and a combination of lever 14 with movable contact 15 can be changed in a direction. These changes allow two kinds of lever switches to be produced, i.e., one differs from the other in a rotating direction of the lever, and yet, the two are made from the same elements.

Figure 8A:
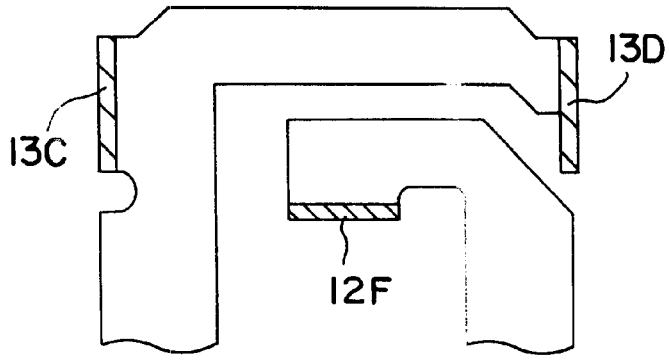
FIG. 8A and FIG. 8B are partial sectional views of still another lever switch in accordance with the second embodiment.
Figure 8B:
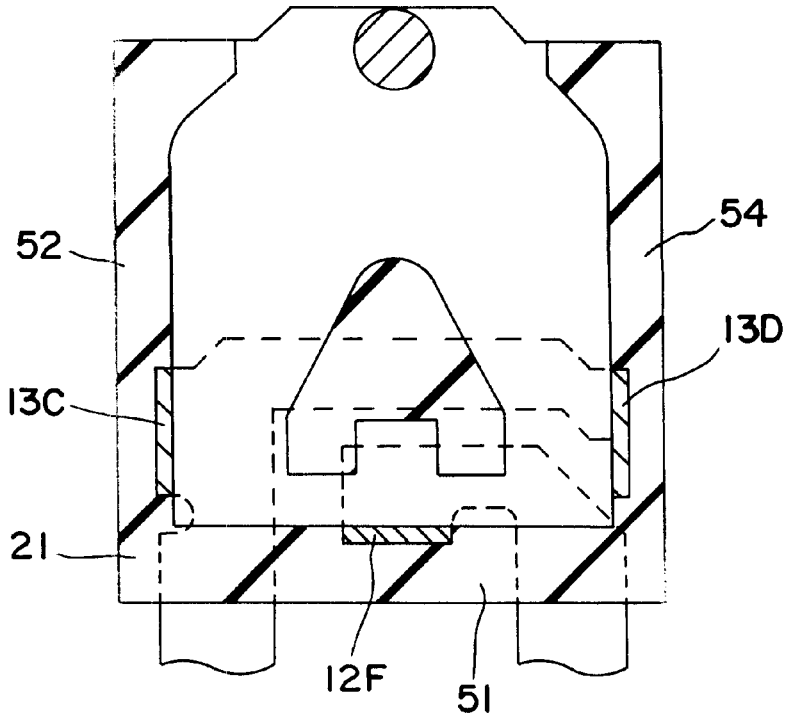
Figure 9A:
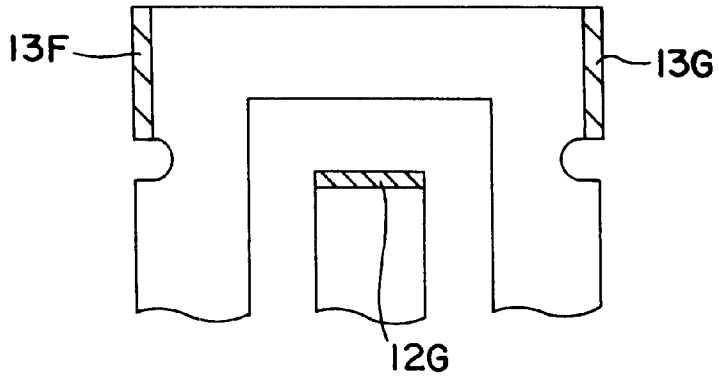
FIG. 9A and FIG. 9B are partial sectional views of a further lever switch in accordance with the second embodiment.
Figure 9B:
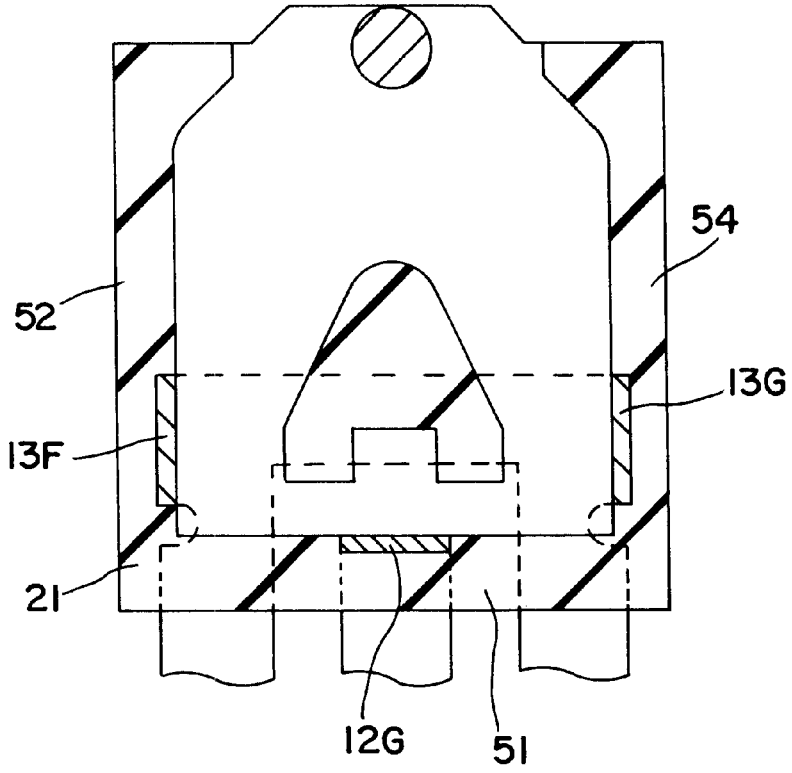
Figure 10:
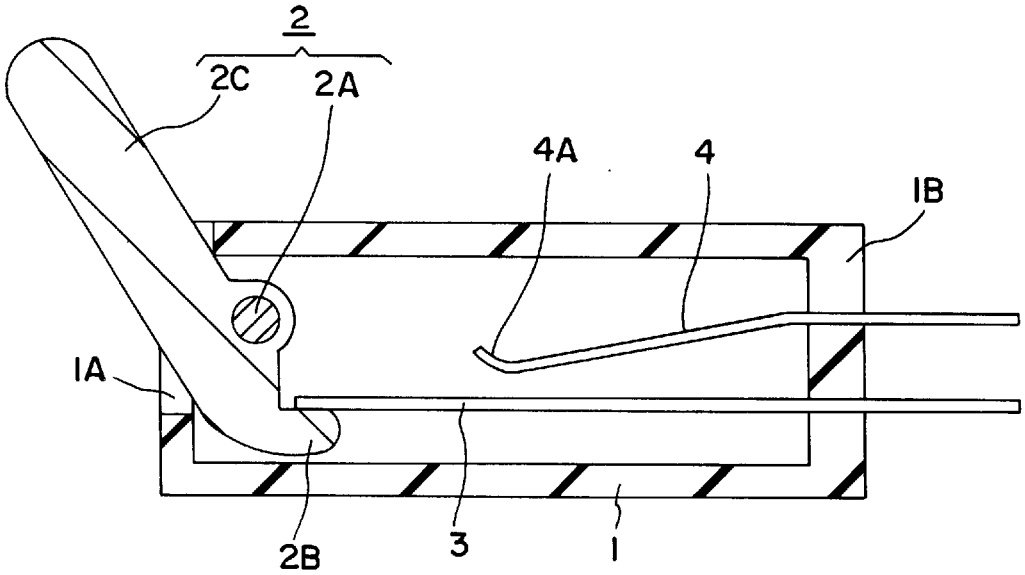
FIG. 10 PRIOR ART
FIG. 10 is a sectional view of a conventional lever switch.
Figure 11:
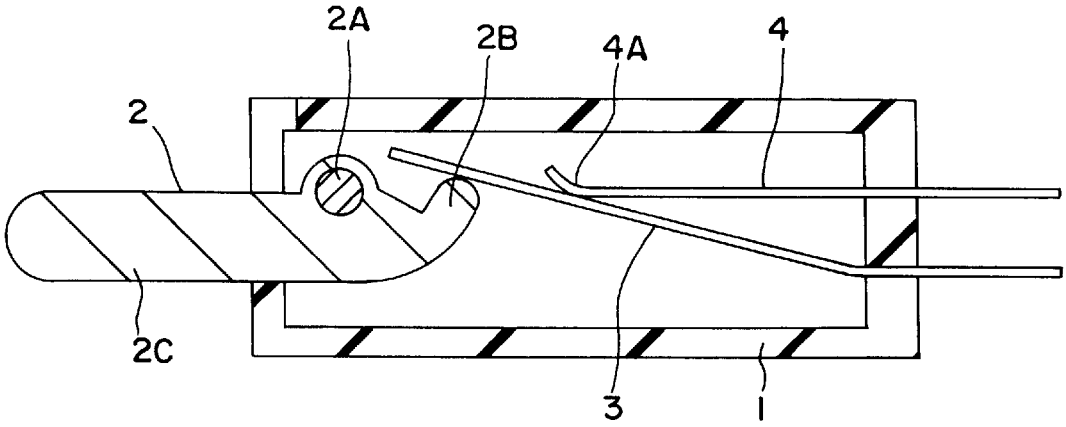
FIG. 11 PRIOR ART
FIG. 11 is a sectional view of the conventional lever switch in operation.

As shown in the partial sectional views of FIG. 8 and FIG. 9, fixed contacts 13C, 13D or 13F, 13G can be shorted respectively and integrated into one body. Then, these shorted bodies can be insert-molded such that they are embedded in the bottom wall of case 21 respectively as shown in FIG. 8B and FIG. 9B. Fixed contacts 13C, 13D or 13F, 13G are symmetrically placed on the left-side and right-side walls with respect to common contacts 12F, 12G. Therefore, a change in a combining direction of lever 14 with movable contact 15 allows two kinds of lever switches to be produced, i.e., one differs from the other in a rotating direction of lever 14.

INDUSTRIAL APPLICABILITY

A lever switch of the present invention assures stable contact just after having its contacts contact with each other. Further, the present invention provides two kinds of lever switches made from the same elements, i.e., one differs from the other in a rotating direction of the lever.

What is claimed is:

1. A lever switch comprising:

a case including:

a first side wall;

a second side wall adjacent to the first side wall; and a third side wall having an opening;

a common contact provided to the first side wall;

a first fixed contact provided to the second side wall;

a supporting protrusion disposed around the common contact in the case;

a lever including:

a shaft section located at an intermediate portion thereof, the shaft section being rotatably held at the opening;

a driving section located at a first end thereof, the driving section being housed in the case; and a handle section located at a second end thereof, the handle section protruding out of the opening outside the case; and an elastic movable contact formed in an approximate V-shape, including:

a bent section located at an intermediate portion thereof, the bent section being bent by the driving section contacting therewith, the bent section being housed in the case;

a first arm extending from a first side of the bent section;

a fixed section provided at a tip of the first arm, the fixed section being mounted between the common contact and the supporting protrusion, the fixed section being formed in an approximate square U-shape;

a second arm extending from a second side of the bent section; and a contact section elastically contacting with the first fixed contact and the second side wall, the contact section being provided at a tip of the second arm.

2. The lever switch of claim 1, wherein the third side wall faces the first side wall.

3. The lever switch of claim 2, wherein the common contact is disposed approximately at a center of the first side wall, wherein the opening is formed approximately at a center of the third side wall, and wherein the shaft section is held approximately at a center of the opening.

4. The lever switch of claim 2, further comprising a second fixed contact short-circuited to the first fixed contact in the case, wherein the case further includes a fourth side wall facing the second side wall, and wherein the second fixed contact is provided to the fourth side wall.

5. The lever switch of claim 1, wherein the third side wall faces the second side wall.

6. The lever switch of claim 1, wherein the movable contact is made of metal.

7. The lever switch of claim 2, wherein the movable contact is made of metal.

8. The lever switch of claim 3, wherein the movable contact is made of metal.

9. The lever switch of claim 4, wherein the movable contact is made of metal.

10. The lever switch of claim 5, wherein the movable contact is made of metal.

* * * * *